United States Patent [19]

Ocone

[11] Patent Number: 4,465,764

[45] Date of Patent: Aug. 14, 1984

[54] USE OF PYROELECTRIC AND PHOTOVOLTAIC POLYVINYLIDENE FLUORIDE TO ENCHANCE THE PHOTOSENSITIVITY OF SILVER HALIDE EMULSIONS AND THE PRODUCTS MADE THEREBY

[75] Inventor: Luke R. Ocone, Springfield Township, Montgomery County, Pa.

[73] Assignee: Pennwalt Corporation, Philadelphia, Pa.

[21] Appl. No.: 428,982

[22] Filed: Sep. 30, 1982

[51] Int. Cl.[3] ..... G03C 1/28

[52] U.S. Cl. ..... 430/496; 430/536; 430/599; 430/531; 430/961

[58] Field of Search ..... 430/536, 599, 961, 531, 430/496

[56] References Cited

U.S. PATENT DOCUMENTS

| | | | |
|---|---|---|---|
| 2,423,749 | 7/1947 | Austin . | |
| 3,411,917 | 11/1968 | Figueras | 430/598 |
| 3,497,357 | 2/1970 | Wang . | |
| 3,713,822 | 1/1973 | Kiess . | |
| 3,931,446 | 1/1976 | Murayama et al. . | |
| 3,992,204 | 11/1976 | Taylor . | |
| 4,047,804 | 9/1977 | Stephens . | |
| 4,055,878 | 11/1977 | Radice | 29/25.35 |
| 4,066,814 | 1/1978 | Chiklis . | |
| 4,241,128 | 12/1980 | Wang . | |
| 4,327,153 | 4/1982 | Micheron . | |

FOREIGN PATENT DOCUMENTS

| | | |
|---|---|---|
| 495263 | 2/1970 | Japan . |
| 55-508 | 1/1980 | Japan . |

*Primary Examiner*—Won H. Louie, Jr.

*Attorney, Agent, or Firm*—Antonelli, Terry & Wands

[57] ABSTRACT

A photosensitive member having a light-sensitive silver halide emulsion coating as the photosensitive layer and at least one sheet of pryoelectric and photovoltaic polyvinylidene fluoride sheet or copolymer thereof in close proximity (e.g., adjacent) to the photosensitive layer is disclosed. During exposure of the photosensitive member, the pyroelectric and photoelectric sheet produces a voltage across the photosensitive layer, which increases the efficiency of the photoelectrons produced by exposure of the photosensitive layer and therefore increases the sensitivity or speed of the photosensitive member. The at least one sheet can be provided as at least part of the support base for the photosensitive layer and/or as a screen overlying the photosensitive layer.

9 Claims, 2 Drawing Figures

USE OF PYROELECTRIC AND PHOTOVOLTAIC POLYVINYLIDENE FLUORIDE TO ENCHANCE THE PHOTOSENSITIVITY OF SILVER HALIDE EMULSIONS AND THE PRODUCTS MADE THEREBY

BACKGROUND OF THE INVENTION

This invention relates to a photosensitive member, such as a photosensitive member utilizing a silver halide light-sensitive coating as the photosensitive layer, having improved speed. More particularly, this invention relates to such a photosensitive member having pyroelectric and photovoltaic polyvinylidene fluoride (PVDF), e.g., poled PVDF, in close proximity to (e.g., adjacent) the photosensitive layer of the photosensitive member to increase the sensitivity of the photosensitive member.

It is known to use various kinds of synthetic resin for at least part of the support of the photosensitive layer of, e.g., a silver halide emulsion. Thus, U.S. Pat. No. 2,423,749 to Austin discloses a film base for a photographic element composed of an orientable vinyl fluoride polymer, the base bearing a stratum of a radiation-sensitive material such as a lightsensitive silver halide. Attention is also directed to U.S. Pat. No. 3,497,357 to Wang, which discloses a film base made from polyvinyl fluoride to receive photographic transfer images.

U.S. Pat. No. 4,087,804 to Stephens and U.S. Pat. No. 4,066,814 to Chiklis disclose the use of fluorinated polymers (including polyvinylidene-containing polymers) for anti-reflection layers on the back of silver halide film supports. The fluorinated polymers are useful for such layers because they have relatively high refractive indices.

The process by which latent images are formed in silver halide photosensitive coatings is as follows. When radiation quanta are absorbed by silver halide, electrons are ejected from the halide ions, leaving halogen atoms, and these electrons migrate randomly at thermal energies through the conduction band of the crystal. Some of the photoelectrons are eventually trapped at defect sites where silver atoms are formed, and small clusters of silver atoms of high stability formed in this way serve as the latent image for the standard photographic development process. The sensitivity or "speed" of silver halide-based products depends on, among other things, the efficiency of latent image formation.

There has been a steady effort to improve the sensitivity of silver halide-based products to provide a faster photosensitive product, because faster products have significant commercial advantages. For example, camera film having improved sensitivity allows photographing at shorter exposure, thus minimizing blurring from moving objects, and it allows fine grain photographs to be made at lower light levels. Faster X-ray film reduces the radiation hazard from some medical radiographic procedures. The commercial products in which improved sensitivity is desirable include silver halide systems used in photocopying, printing plates, and other graphic arts applications as well as in camera and X-ray products.

The efficiency of latent image formation, on which sensitivity depends in part, is limited by several factors. First, a part of the absorbed radiation produces only local heating, even when the emulsions contain color sensitizers and when intensifying devices such as phosphor screens are used. In addition, some of the photoelectrons that are produced recombine with the halogen atoms and make no net contribution to the formation of a latent image. If the net yield of photoelectrons were increased, e.g., recombination of halogen and photoelectrons were reduced, the efficiency of latent image formation would increase, and therefore the sensitivity of the silver-halide based product would increase.

When exposure is carried out with an electric field across the emulsion, the photoelectric current in the silver halide crystals is increased and recombination of halogen and photoelectrons is reduced. However, facilitating the formation of a stable latent image by imposing a voltage across the coating during exposure is cumbersome in practice.

SUMMARY OF THE INVENTION

Accordingly, it is an object of this invention to provide a photosensitive member, utilizing a silver halide coating as the photosensitive layer, having increased sensitivity.

It is a further object of this invention to provide a photosensitive member wherein the net yield of photoelectrons is increased for more effective image and data recording.

It is a further object of this invention to provide a photosensitive member wherein a voltage is produced across the silver halide coating during exposure to increase the sensitivity of the photosensitive member utilizing said coating.

It is a further object of this invention to provide a method of forming a latent image in a photosensitive coating of, e.g., a silver halide emulsion, wherein, during exposure of the photosensitive coating, a voltage is produced across the coating to increase the sensitivity, or speed, of the photosensitive member having said coating.

It is a further object of this invention to provide a photosensitive member having a silver halide coating as the photosensitive layer and, e.g., a sheet of material in close proximity to said coating for producing a voltage across the coating during exposure.

In order to accomplish the foregoing objects, applicant provides a photosensitive member that utilizes a sheet of pyroelectric and photovoltaic PVDF or copolymers thereof in close proximity to (e.g., adjacent) the silver halide coating so that during exposure of the photosensitive member, a voltage is produced across the silver halide coating, whereby recombination of the photoelectrons and halogen atoms in the silver halide coating is decreased.

DETAILED DESCRIPTION OF THE INVENTION

Figure 1:
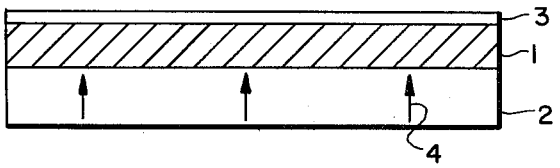
FIG. 1 is a cross-sectional view of one embodiment of the invention.

FIG. 1 shows a cross-sectional view of one embodiment of the invention, wherein the poled PVDF sheet is utilized as the support for the silver halide emulsion coating. In FIG. 1, silver halide emulsion 1 is coated on a pyroelectric PVDF sheet 2. The silver halide can be, e.g., silver chloride, silver bromide or silver iodide or the conventionally used combinations of these. Such coating can be accomplished by conventional methods, e.g., by dip coating and air knifing or by the several different kinds of roll coating. The emulsion is shown top-coated with a protective layer 3, as is done conventionally. The arrows 4 in sheet 2 indicate the sheet has been poled normal or perpendicular to its surface.

Figure 2:
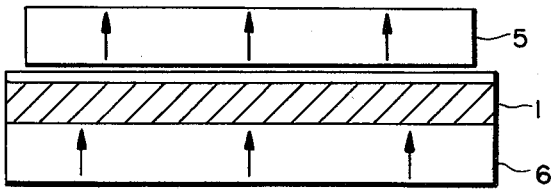
FIG. 2 is a cross-sectional view of a second embodiment of the invention.

FIG. 2 shows a second embodiment of the invention, wherein pyroelectric PVDF sheet 5 is positioned as a screen overlying the silver halide emulsion during exposure. Structure the same as in FIG. 1 is denoted with the same reference characters as used in FIG. 1. The base 6 can be either the standard plastics now used commercially or a pyroelectric PVDF sheet as shown. If both the base and screen are pyroelectric, then they should be oriented so that the induced voltages reinforce and not oppose each other.

On exposure, e.g., exposure to light or other radiation as conventionally done, local heating of the emulsion and PVDF sheet will result in local transient voltages proportional to the exposure intensity at each point and these will facilitate charge separation and reduce recombination of the photoelectrons and halogen atoms in the silver halide coating. Pyroelectric PVDF also exhibits a photovoltaic effect, which will augment voltage generation and further facilitate charge separation and reduce recombination.

U.S. Pat. No. 3,992,204 to Taylor describes structure in which a photoconductive layer is bonded to one or two pyroelectric layers, which may be poled, oriented sheets of PVDF. In the structure disclosed by Taylor, an electrostatic image is formed on the surface of the pyroelectric sheet by charging and selective discharging, and then this electrostatic latent image is developed with a conventional xerographic toner. The developed image is then transferred to paper and fused, whereupon the structure is restored to its original condition and is able to receive a new electrostatic latent image. The photoconductive layer acts merely as a switch, conductive only when illuminated. As can be appreciated, the photoconductive layer of the structure disclosed in Taylor cannot be a silver halide photographic emulsion.

U.S. Pat. No. 3,713,822 to Kiess discloses a reusable surface for generating electrostatic images that can be toner-developed and transferred to paper. The structure disclosed in Kiess includes a mosaic of pyroelectric crystals, which, like the structure disclosed in Taylor, can be uniformly charged through the pyroelectric effect and selectively discharged by incident radiation.

As can be appreciated, in the structures of Taylor and Kiess no significant chemical or physical changes occur in the photoconductive layer in one cycle, and the photoconductive layers can be used for many copy cycles. In contrast, the photoconductive layer of the present invention is a silver halide emulsion, which undergoes a permanent change upon illumination or irradiation even in the absence of an applied field during exposure. The voltage produced across the photosensitive layer by the pyroelectric layer in close proximity (e.g., adjacent) thereto intensifies the changes in the silver halide caused by the radiation. It should be pointed out that, in the present invention, the essential flow of photoelectrons that affects latent image formation takes place within the silver halide grains in the photosensitive layer, although some flow of photoelectrons may be observed through the layer itself. Moreover, a developable electrostatic image is not formed in the present invention. Thus, it can be seen that the purposes and mode of operation, as well as the structure, of Taylor and Kiess, on the one hand, differ from the present invention.

Moreover, the U.S. Pat. Nos. 2,423,749; 3,497,357; 4,047,804; and 4,066,814, discussed previously, are noted. Each of these U.S. patents discloses use of a fluorinated polymer (e.g., polyvinyl fluoride and polyvinylidene fluoride-containing polymers) as part of the support of silver halide photosensitive layers. However, such fluorinated polymers are not disclosed as being poled, and therefore they cannot exhibit a pyroelectric effect and cannot contribute to latent image formation as described previously.

Voltage generation by the pyroelectric and photovoltaic effects can be optimized by strategies such as putting absorptive materials for absorbing the light or other radiation on or in the PVDF or, in the case of X-rays, the use of radio-opaque coatings or screens. The various structures formed utilizing these strategies are not shown in FIGS. 1 and 2, which show only the essential elements required for an understanding of the novel features of this patent. Standard features of silver halide emulsion photosensitive members, e.g., photographic film, such as anti-curl back coatings and anti-halation layers are not shown, nor are the great variety of product configurations. Support materials such as glass and metal or other stiffer plastic sheets can be used in some applications. The pyroelectric PVDF sheets of this invention can be laminated to these stiffer sheets by a variety of well-known techniques. In addition, some radiographic products are coated on both sides of the support layer, in which case pyroelectric PVDF sheets might be used in contact with both photosensitive layers during exposure and also used, optionally, as the support layer for the emulsion.

To exert maximum effect, the photosensitive silver halide emulsion layer should be close to the voltage-generating layers. However, direct contact will not always be possible. For example, it may be necessary to precoat the pyroelectric sheet with a layer (usually quite thin) to promote adhesion of the silver halide layer, and silver halide sensitometric layers are normally topcoated with a protective gel layer. Also, many sensitometric products (for example, color films) have a number of silver halide layers separated from each other by nonsilver halide layers. Direct contact of the pyroelectric sheet with all the photosensitive layers is obviously not possible, but the latent image intensification described herein will be observed nevertheless. It follows from the discussion above that the present invention is applicable to silver halide sensitometric products with all these diverse features.

Single sheets or stacks of pyroelectric PVDF sheets can be substituted directly for the flexible base for silver halide photosensitive products now in general use for such products. In addition, a transparent pyroelectric sheet can be used as an intensifying screen held in contact with the silver halide emulsion layer during exposure, as shown in FIG. 2. When the pyroelectric sheet must be handleable and stiff enough to support the silver halide coating, the preferred thickness is between 0.05 and 0.5 mm. Thinner sheets are not stiff enough to permit easy handling, but they can be used if laminated to thicker sheets of plastic, metal, or glass. One application for such a structure, having the PVDF sheet laminated to thicker sheets of plastic, metal or glass, is in silver halide photolithographic plates. The thicknesses of the silver halide coating, or silver halide coating weights, of the layers in the various products will depend on the use to which each product is put and the characteristics desired. One can achieve a given speed in a product, e.g., X-ray film, with less silver halide than is customarily used, or alternatively, one can achieve higher sensitivity at the customary silver halide coating weight. This approach to image intensification is effective on products with a low silver halide coating weight such as on black-and-white negative stock as well as on products with heavy coating weights such as medical X-ray film.

Sheets made from PVDF homopolymer or copolymer can be rendered pyroelectric and photovoltaic by freezing in the polarization that results when uniaxially oriented sheets of PVDF are held at an elevated temperature (over 80° C.) in an electric field. The general methods of preparing pyroelectric and piezoelectric PVDF are well-known in the art and are described in U.S. Pat. No. 4,055,878, among other places. These methods can also be used to impart pyroelectric, and piezoelectric properties to copolymers of vinylidene fluoride with vinyl fluoride, trifluoroethylene, chlorotrifluoroethylene, and tetrafluoroethylene as well as alloys of vinylidene fluoride with other resins such as acrylates. Such methods can be used herein. The piezoelectric and pyroelectric properties of poled PVDF were described first by Kawai in *Japan J. Appl. Phys.*, 8, 975 (1969) and *Oyo Butsuri*, 38 (12), 1133 (1969), and since that time many manufacturing variations have been described in the literature and in patents. The anomalous photovoltaic effect in poled PVDF was described much later in Sasabe, H., et al., *Polymer Journal*, Vol. 13, No. 10, pp. 967–973 (1981).

The value of the pyroelectric constant in poled PVDF depends on a number of process variables such as the degree of orientation and the polarizing voltage. Those materials exhibiting a pyroelectric coefficient over, e.g., 10 $\mu Cm^{-2}\,{}^{\circ}K.^{-1}$ are advantageous for the present invention. The anomalous photovoltaic effect in poled polyvinylidene fluoride depends on the generation of electronic carriers by light excitation, and the carriers are then transported in the internal field. The effect is therefore a function of the degree of polarization, which also determines the pyroelectric coefficient for a given sample. The molecular weight of the PVDF or its copolymers should be over 15,000 Daltons and preferably over 20,000 Daltons.

While I have shown and described several embodiments in accordance with the present invention, it is understood that the same is not limited thereto but is susceptible of numerous changes and modifications as known to one having ordinary skill in the art and I therefore do not wish to be limited to the details shown and described herein, but intend to cover all such modifications as are encompassed by the scope of the appended claims.

I claim:

1. A photosensitive member comprising:

(a) at least one photosensitive layer of a silver halide emulsion; and (b) at least one sheet of poled polyvinylidene fluoride or copolymer or alloy polymer thereof in close proximity to said at least one photosensitive layer, said at least one sheet acting to produce a voltage across the at least one photosensitive layer during exposure of the at least one photosensitive layer, to increase the sensitivity of the at least one photosensitive layer as compared to the sensitivity of photosensitive layers without having said voltage produced by said at least one sheet thereacross.

2. A photosensitive member according to claim 1, wherein said at least one sheet is spaced from said at least one photosensitive layer by at least one additional layer.

3. A photosensitive member according to claim 1, wherein said at least one sheet is at least part of a base support for said at least one photosensitive layer.

4. A photosensitive member according to claim 1, wherein said at least one sheet is a screen extending over the surface of said at least one photosensitive layer opposite to the surface of said at least one photosensitive layer nearest a base support for said at least one photosensitive layer.

5. A photosensitive member according to claim 1, wherein said at least one sheet comprises: (1) a first set of at least one sheet that is at least part of a base support for said at least one photosensitive layer; and (2) a second set of at least one sheet that is a screen extending over the photosensitive layer surface opposite to the surface nearest said base support, and wherein said first set and said second set are aligned such that the induced voltages reinforce each other.

6. A photosensitive member according to claim 3, wherein said at least one sheet is laminated to a support member.

7. A photosensitive member according to claim 3, wherein said at least one sheet constitutes the base support.

8. A photosensitive member according to claim 7, wherein said at least one sheet has a thickness of 0.05–0.5 mm, whereby said sheet is handleable and stiff enough to support said at least one photosensitive layer.

9. A photosensitive member according to claim 1, wherein the pyroelectric coefficient of said at least one sheet is over 10 $\mu cm^{-2}\,{}^{\circ}K.^{-1}$.

* * * * *